US009161425B2

(12) United States Patent
Burayez et al.

(10) Patent No.: US 9,161,425 B2
(45) Date of Patent: Oct. 13, 2015

(54) LIGHTING DEVICE CONTROL USING VARIABLE INDUCTOR

(75) Inventors: Ammar Burayez, Silverado, CA (US); Ivan Ivanov, Fountain Valley, CA (US); William A. Hunt, Foothill Ranch, CA (US); John W. Matthews, Newport Beach, CA (US)

(73) Assignee: SureFire, LLC, Fountain Valley, CA (US)

( * ) Notice: Subject to any disclaimer, the term of this patent is extended or adjusted under 35 U.S.C. 154(b) by 111 days.

(21) Appl. No.: 13/570,820

(22) Filed: Aug. 9, 2012

(65) Prior Publication Data

US 2013/0043807 A1 Feb. 21, 2013

Related U.S. Application Data

(60) Provisional application No. 61/524,734, filed on Aug. 17, 2011.

(51) Int. Cl.
*H05B 37/02* (2006.01)
*H05B 41/391* (2006.01)

(52) U.S. Cl.
CPC ..... *H05B 41/391* (2013.01); *H05B 37/02* (2013.01)

(58) Field of Classification Search
CPC .. H05B 37/029; H05B 37/02; H05B 41/3925; H05B 41/391; H05B 41/2828
USPC ..... 315/291, 209 R, 226, 278, 224; 362/205
See application file for complete search history.

(56) References Cited

U.S. PATENT DOCUMENTS

| | | | | |
|---|---|---|---|---|
| 4,162,429 | A * | 7/1979 | Elms et al. | 315/284 |
| 5,432,526 | A * | 7/1995 | Hyatt | 345/87 |
| 6,160,355 | A | 12/2000 | Yee | |
| 6,229,270 | B1 * | 5/2001 | Stephenson et al. | 315/291 |
| 6,841,941 | B2 | 1/2005 | Kim et al. | |
| 7,186,002 | B2 | 3/2007 | Matthews et al. | |
| RE40,125 | E | 3/2008 | Matthews et al. | |
| 7,540,625 | B2 | 6/2009 | Matthews et al. | |
| 8,413,523 | B2 * | 4/2013 | Bessho | 73/861.27 |
| 8,692,410 | B2 * | 4/2014 | Schatz et al. | 307/104 |
| 2007/0247839 | A1 * | 10/2007 | Matthews et al. | 362/205 |
| 2009/0326406 | A1 * | 12/2009 | Tan et al. | 600/546 |
| 2012/0046765 | A1 * | 2/2012 | Nikolic et al. | 700/90 |
| 2012/0307229 | A1 * | 12/2012 | Conroy et al. | 356/5.1 |
| 2013/0043807 | A1 * | 2/2013 | Burayez et al. | 315/291 |

FOREIGN PATENT DOCUMENTS

| | | |
|---|---|---|
| GB | 661705 | 11/1951 |
| WO | WO 99/07190 | 2/1999 |

* cited by examiner

*Primary Examiner* — Jimmy Vu
*Assistant Examiner* — Syed M Kaiser
(74) *Attorney, Agent, or Firm* — Haynes and Boone, LLP

(57) ABSTRACT

Various techniques are provided for implementing a lighting device variable control using a variable inductor. In various examples, the variable control may be implemented with a plurality of continuous or stepped settings. The variable control may be adjusted by a user-actuated movement of a part of the lighting device, such as the depression of a tail cap or another appropriate physical control to change the inductance of the variable inductor. An oscillating signal may be induced in a variable inductor circuit that includes the variable inductor. The oscillating signal may exhibit characteristics, such as frequency, that change with the inductance of the variable inductor. Such characteristics may be measured to determine a setting of the variable control and which may be used to adjust the brightness or other attributes of the lighting device.

23 Claims, 5 Drawing Sheets

LIGHTING DEVICE CONTROL USING VARIABLE INDUCTOR

CROSS-REFERENCE TO RELATED APPLICATIONS

This application claims the benefit of U.S. Provisional Patent Application No. 61/524,734 filed Aug. 17, 2011 which is hereby incorporated by reference in its entirety.

BACKGROUND

1. Field of the Invention

The present disclosure generally relates to lighting devices and more particularly to controls for lighting devices.

2. Related Art

Various types of lighting devices may be used to illuminate areas of interest. For example, portable lighting devices are often used by law enforcement, military personnel, emergency/medical personnel, divers, hikers, search/rescue teams, and other users.

Many existing portable lighting devices have conventional switches that allow a user to adjust the brightness or other functions of the lighting devices. However, the number of settings available using conventional switches is often limited, and such configurations may hamper the functionality of the lighting devices. For example, lighting devices with only two brightness settings may not provide a sufficient number of illumination levels in different lighting conditions. While switches with multiple settings are available, they often require costly mechanical configurations, may require the user to change hand positions, or may require a second hand to operate.

Accordingly, there is a need for an improved lighting device that overcomes one or more of the deficiencies discussed above.

SUMMARY

In accordance with various embodiments described herein, a variable control for a lighting device may be implemented with a variable inductor. In various embodiments, the variable control may be implemented with a plurality of continuous or stepped settings. The variable control may be adjusted by a user-actuated movement of a part of the lighting device, such as the depression of a tail cap or another appropriate physical control to change the inductance of the variable inductor. An oscillating signal may be induced in a variable inductor circuit that includes the variable inductor. The oscillating signal may exhibit characteristics, such as frequency, that change with the inductance of the variable inductor. Such characteristics may be measured to determine a setting of the variable control and which may be used to adjust the brightness or other attributes of the lighting device.

In one embodiment, a lighting device includes a light source; and a variable control adapted to provide a plurality of control settings, wherein the variable control comprises: a physical control adapted to be selectively positioned by a user, a variable inductor circuit adapted to exhibit a change in inductance based on the physical control, and a control circuit adapted to induce an oscillating signal in the variable inductor circuit, measure the oscillating signal to determine a control setting associated with the change in inductance, and control the light source using the determined control setting, wherein the oscillating signal changes with the inductance of the variable inductor circuit.

In another embodiment, a method of operating a lighting device includes receiving a user manipulation of a physical control that causes a variable inductor circuit to exhibit a change in inductance; inducing an oscillating signal in the variable inductor circuit, wherein the oscillating signal changes with the inductance of the variable inductor circuit; measuring the oscillating signal to determine a control setting associated with the change in inductance; and controlling a light source using the determined control setting.

The scope of the invention is defined by the claims, which are incorporated into this section by reference. A more complete understanding of embodiments of the disclosure will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE FIGURES

Embodiments of the disclosure and their advantages are best understood by referring to the detailed description that follows. It should be appreciated that like reference numerals are used to identify like elements illustrated in one or more of the figures.

DETAILED DESCRIPTION

Various techniques are provided for implementing and operating variable controls using variable inductors. Such variable controls may be used to provide continuous or stepped control signals to lighting devices such as flashlights, headlamps, or other lighting devices. The variable controls may sense (e.g., detect) changes in inductance caused by user-actuated movements, such as the depression of a tail cap or another appropriate control surface to adjust the brightness or other attributes of the lighting devices. The detected changes may be used to determine one or more settings of the lighting devices and thus control various aspects of the lighting devices, such as the brightness of light sources of the lighting devices, or other aspects.

Figure 1:
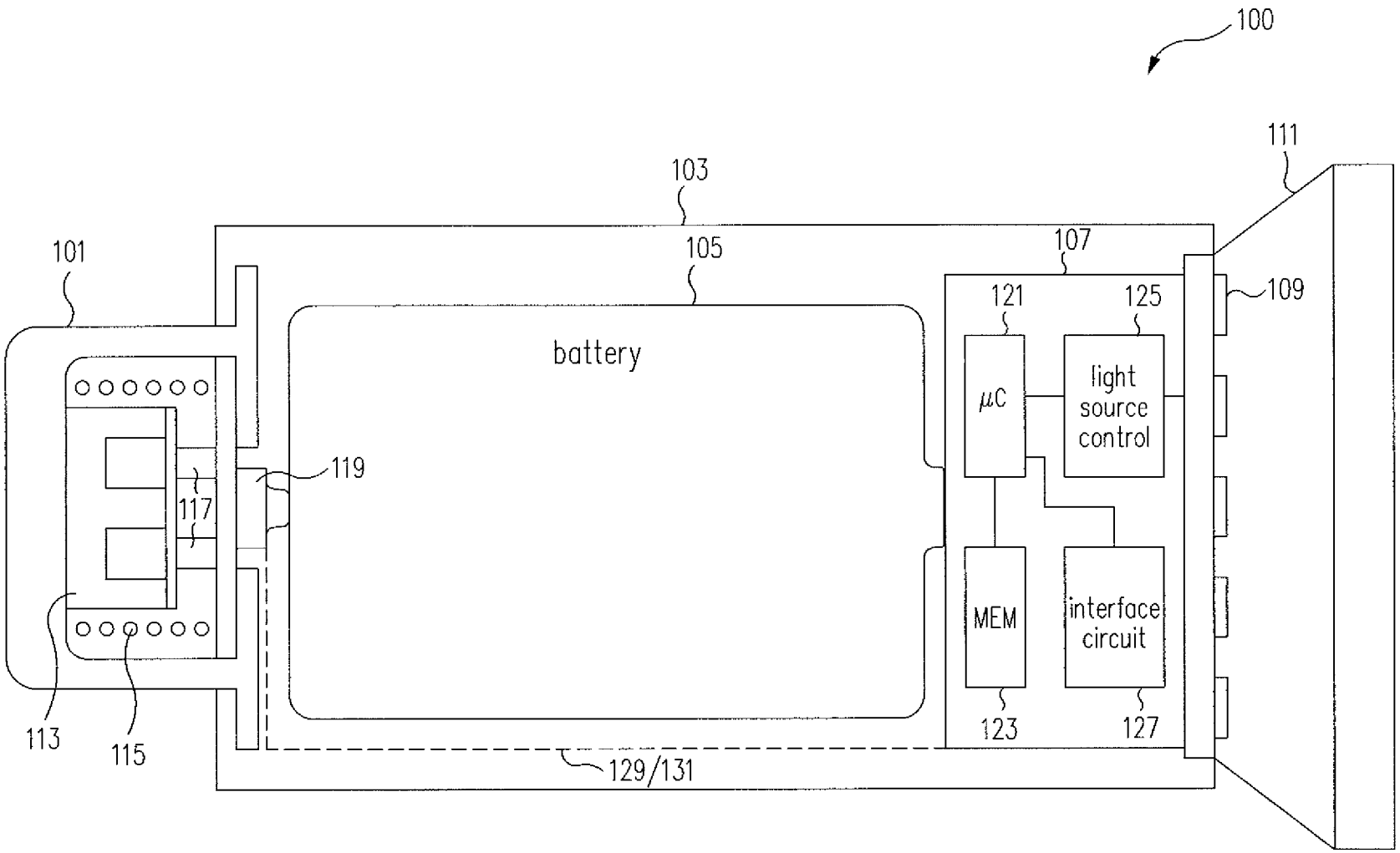
FIG. 1 illustrates a cross sectional view of a lighting device including a variable control using a variable inductor in accordance with an embodiment of the disclosure.

FIG. 1 illustrates a cross sectional view of a lighting device 100 including a variable control using a variable inductor in accordance with an embodiment of the disclosure. In one embodiment, lighting device 100 includes a detachable tail cap 101 that attaches to a body 103 of the lighting device 100. Tail cap 101 may be flexibly coupled to body 103 such that tail cap 101 may be pressed so that it is selectively recessed into body 103 up to a certain depth. In one embodiment, a user may press tail cap 101 so that tail cap 101 is recessed into body 103 by up to 5 mm. Other depression depths may be used in other embodiments. The user may control the setting of the variable control by applying different levels of force to tail cap 101.

Body 103 provides a housing for a battery 105 and a control circuit 107. In one embodiment, control circuit 107 may be positioned near a front end (e.g., head end) of lighting device 100 with battery 105 interposed between tail cap 101 and control circuit 107. In another embodiment, control circuit 107 may be positioned proximate to tail cap 101 near a tail end of lighting device 100. Control circuit 107 includes circuitry for controlling various aspects of lighting device 100 in response to user-actuated movements of a physical control, such as tail cap 101. Control circuit 107 may control power provided to one or more light sources 109 (e.g., light emitting diodes (LEDs), incandescent bulbs, or other light sources) housed in an optical assembly 111. In one embodiment, optical assembly 111 may include a total internal reflection (TIR) lens to reflect light emitted from light sources 109 to project a light beam from lighting device 100. Battery 105 provides power to control circuit 107 and to light sources 109.

Tail cap 101 may have a rubberized outer surface enclosing an inner cavity. Mounted against the inner cavity at the tail end of tail cap 101 is an actuator 113 that is circularly surrounded by a coil of a spring 115 running the depth of the cavity. Spring 115 provides tension force to push against tail cap 101 when a user presses on tail cap 101. Actuator 113 pushes against a magnetic coil 117 whose magnetic field varies with the level of force exerted against magnetic coil 117. As the user pushes on tail cap 101, actuator 113 compresses magnetic coil 117 to change the magnetic field of magnetic coil 117. The changing magnetic field induces a change in the inductance of a variable inductor mounted on a base plate 119. The changing inductance may be sensed by control circuit 107 to detect changes in the settings of the variable control.

Figure 2:
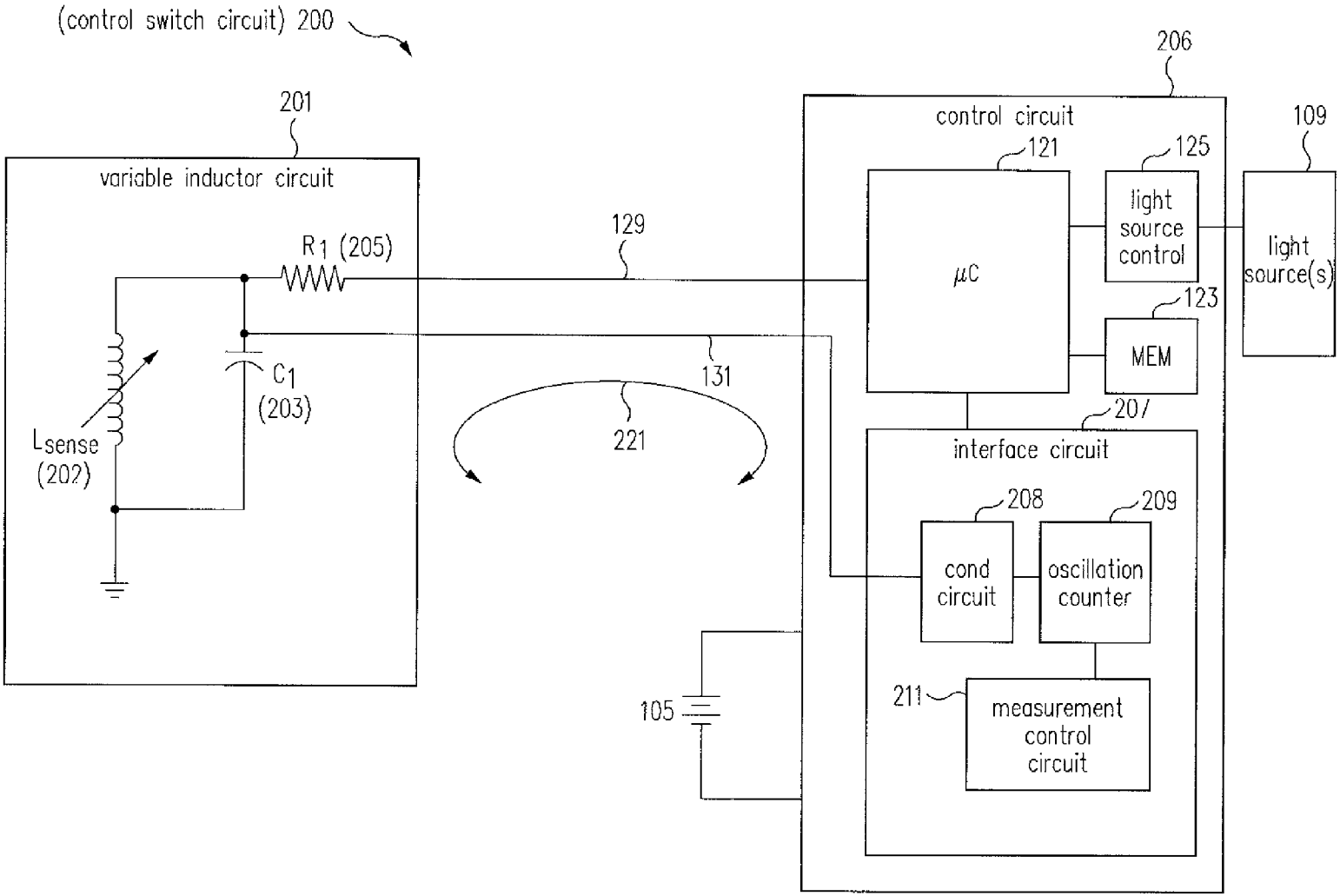
FIG. 2 illustrates a schematic of a variable control circuit implemented by a variable inductor circuit connected to a control circuit through at least one conductive wire in accordance with an embodiment of the disclosure.
Figure 4:
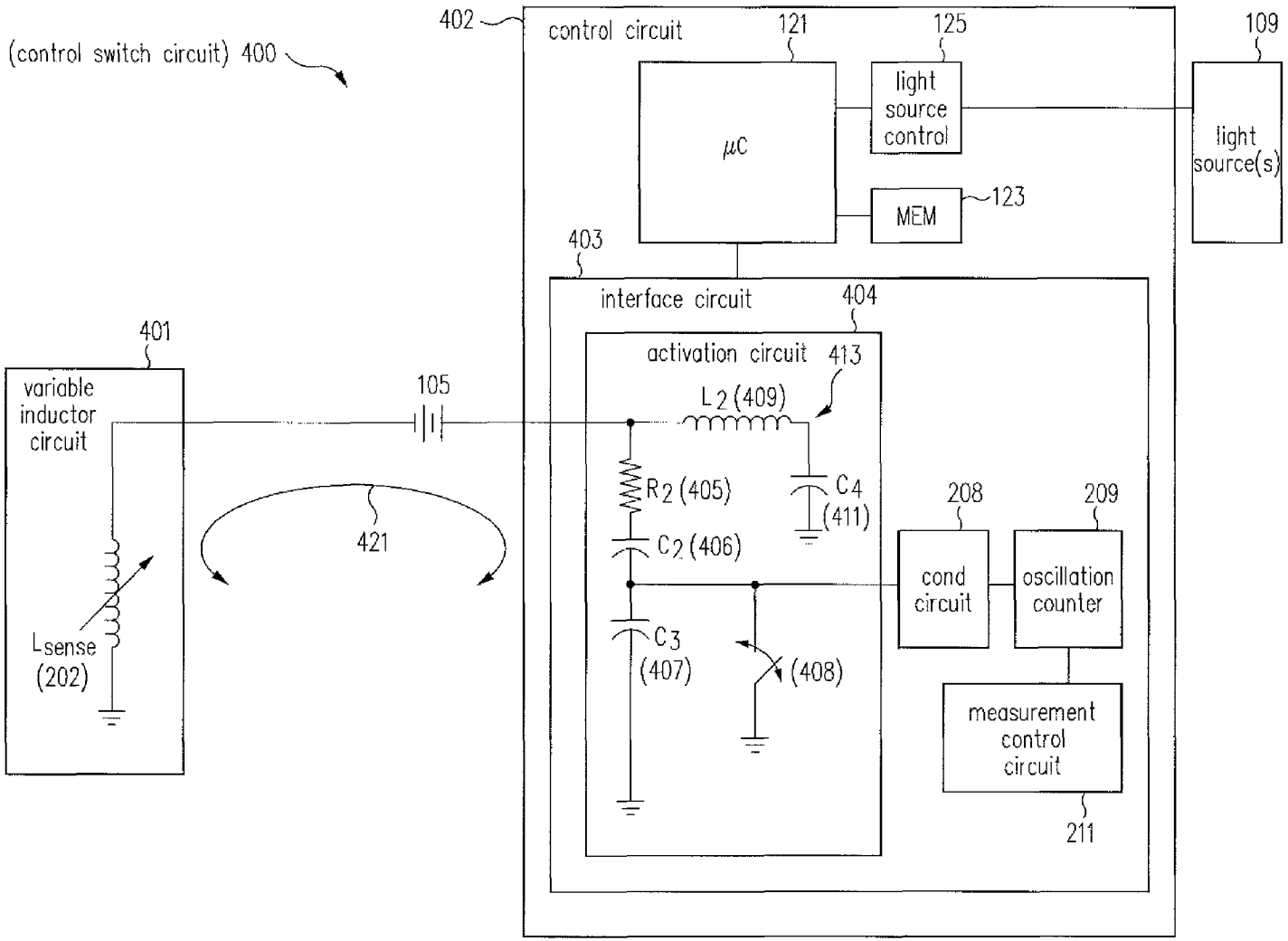
FIG. 4 illustrates a schematic of another variable control circuit implemented by another variable inductor circuit connected to another control circuit through a battery in accordance with an embodiment of the disclosure.

A variable inductor circuit (e.g., several embodiments of which are shown in and further described with regard to FIGS. 2 and 4) uses the variable inductance of the variable inductor to output an oscillating signal when the variable inductor circuit is activated by control circuit 107. In this regard, control circuit 107 may induce (e.g., activate) the oscillating signal in the variable inductor circuit by, for example, providing a pulse (e.g., a voltage pulse and/or a current pulse). Control circuit 107 may detect the oscillating signal to measure its characteristics, such as the frequency of the oscillating signal. In one embodiment, the frequency of the oscillating signal may vary as a function of the inductance of the variable inductor. Thus, as the user operates the variable control by pressing on tail cap 101 to change the inductance of the variable inductor, control circuit 107 may activate the variable inductor circuit, and the frequency of the oscillating signal may change in response to the change in inductance caused by the user's operation of tail cap 101. By measuring the frequency of the oscillating signal, control circuit 107 may determine the setting of the variable control. In one embodiment, the variable inductor circuit may be located on base plate 119. In one embodiment, one or more wires 129/131 may connect the variable inductor circuit with control circuit 107 to activate the variable inductor circuit and to measure the frequency of the oscillating signal. In another embodiment, wires 129/131 may not be provided. In this case, battery 105 may provide the connection between the variable inductor circuit and control circuit 107.

Control circuit 107 includes a processor 121, a memory 123, a light source control circuit 125, and an interface circuit 127. Processor 121 may be implemented by a microcontroller, a microprocessor, logic, a field programmable gate array (FPGA), or any other appropriate circuitry. Memory 123 may include non-volatile memories and/or volatile memories. Memory 123 may be used to store instructions for execution by processor 121 such as to activate the variable inductor circuit and to measure the frequency of the oscillating signal, and/or may be used to store saved parameters such as saved settings of the variable control. Such saved settings allow lighting device 100 to save the settings of the variable control in effect before power to lighting device 100 is turned off and to restore the settings when power to lighting device 100 is turned back on. Memory 123 may also include scratch memories used by processor 121 to store variable values when executing instructions.

Interface circuit 127 includes circuitry under control of processor 121 to interface with the variable inductor circuit. Interface circuit 127 may detect that the user has placed lighting device 100 in a control setting mode to change the setting of the variable control, such as when the user rotates or otherwise actuates tail cap 101, or any other appropriate mechanism or control of lighting device 100. In one embodiment, interface circuit 127 may generate a pulse to activate the variable inductor circuit and to measure the frequency of the oscillating signal. In another embodiment, processor 121 may generate a pulse to activate the variable inductor circuit and interface circuit 127 may measure the frequency of the oscillating signal. Processor 121 may use the measured frequency from interface circuit 127 to determine a setting of the variable control for controlling a function of lighting device 100. For example, processor 121 may determine the brightness control setting for light sources 109 from the measured frequency. Interface circuit 127 may also be used to selectively connect lighting device 100 to other devices. For example, in one embodiment, interface circuit 127 may include a Universal Serial Bus (USB) port to pass data between device 100 and one or more other connected devices such as external flash memories.

Light source control circuit 125 includes circuitry under control of processor 121 to control the brightness of light sources 109. For example, light source control circuit 125 receives the brightness control setting from the processor 121 (e.g., determined by processor 121 based on the user-selected position of the variable control caused by the user selectively depressing tail cap 101) to adjust the brightness of light sources 109. Light source control circuit 125 may adjust the brightness of light sources 109 using techniques such as pulse width modulation (PWM), by controlling the number of light sources receiving power, or through other appropriate techniques.

FIG. 2 illustrates a schematic of a variable control circuit 200 implemented by a variable inductor circuit 201 connected to a control circuit 206 through two conductive wires 129/131 in accordance with an embodiment of the disclosure. Variable control circuit 200 may be used with a physical control manipulated by a user such as tail cap 101 to allow the user to adjust the variable control. Control circuit 206 is one embodiment of control circuit 107 of FIG. 1. Control circuit 206 includes processor 121, light source control circuit 125 and memory 123 as discussed with regard to FIG. 1. Control circuit 206 also includes an interface circuit 207 that is an embodiment of interface circuit 127 of FIG. 1. In one embodiment, variable inductor circuit 201 is located on base plate 119 near tail cap 101 and includes a variable inductor 202 with variable inductance $L_{sense}$ connected in parallel with a capacitor 203 with capacitance $C_1$. $L_{sense}$ may vary as a user applies different levels of force on tail cap 101 to induce a changing magnetic field on variable inductor 202. Variable inductor circuit 201 also includes a resistor 205 with resistance $R_1$ connected in series with the variable inductor 202/capacitor 203 network. Resistor 205 connects to processor 121 through a first wire 129 running from variable inductor circuit 201 to control circuit 206. Processor 121 may activate oscillation of variable inductor circuit 201 by applying a pulse on first wire 129. A second wire 131 from capacitor 203 to interface circuit 207 is used by interface circuit 207 to sense the frequency of the oscillating signal (e.g., denoted in FIG. 2 by semi-circular arrows 221) from variable inductor circuit 201.

Interface circuit 207 includes a conditioning circuit 208 that connects with second wire 131. Conditioning circuit 208 may include amplification circuitry to amplify the oscillating signal (e.g., amplify the voltage and/or current), filters to filter out high frequency spurious signals, and/or waveform shaping circuitry to shape the oscillating signal. Interface circuit 207 also includes an oscillation counter 209 used to measure the frequency of the oscillating signal under control of a measurement control circuit 211. Frequency of the oscillating signal may be measured with various techniques, such as using conditioning circuit 208 to shape the oscillating signal into a clock signal for clocking oscillation counter 209. By counting the number of clocks in a measurement interval, oscillation counter 209 may be used to derive the frequency of the oscillating signal. Alternatively, the oscillating signal may be sampled and processed using Fast Fourier Transform (FFT) to measure its spectral content. The magnitude of a maximum frequency bin of the spectral content may be compared against a detection threshold to detect the main frequency of the oscillating signal.

To activate the oscillation circuit, control circuit 107 may detect when the user has placed lighting device 100 into a control setting mode to change the setting of the variable control, such as when the user rotates tail cap 101 actuates tail cap 101, or any other appropriate mechanism or control of lighting device 100. Processor 121 activates variable inductor circuit 201 by generating a pulse on first wire 129 through a port on processor 121, such as through a general purpose I/O (GPIO) port. Alternatively, first wire 129 may be connected to interface circuit 207, and processor 121 may cause interface circuit 207 to generate the pulse. The pulse charges capacitor 203 to build up a voltage with a time constant determined by $C_1$ and $R_1$. The duration of the pulse may be adjustable as a function of the time constant. At the termination of the pulse, the voltage on capacitor 203 discharges, causing variable inductor circuit 201 to oscillate with a frequency that is determined by $L_{sense}$, $C_1$, and $R_1$. Because $L_{sense}$ varies as the user applies different amounts of force on tail cap 101 to adjust the variable control, the frequency of the oscillating signal may be measured to determine the setting of the variable control. This oscillating signal on capacitor 203 is sensed by interface circuit 207 through second wire 131.

Figure 3:
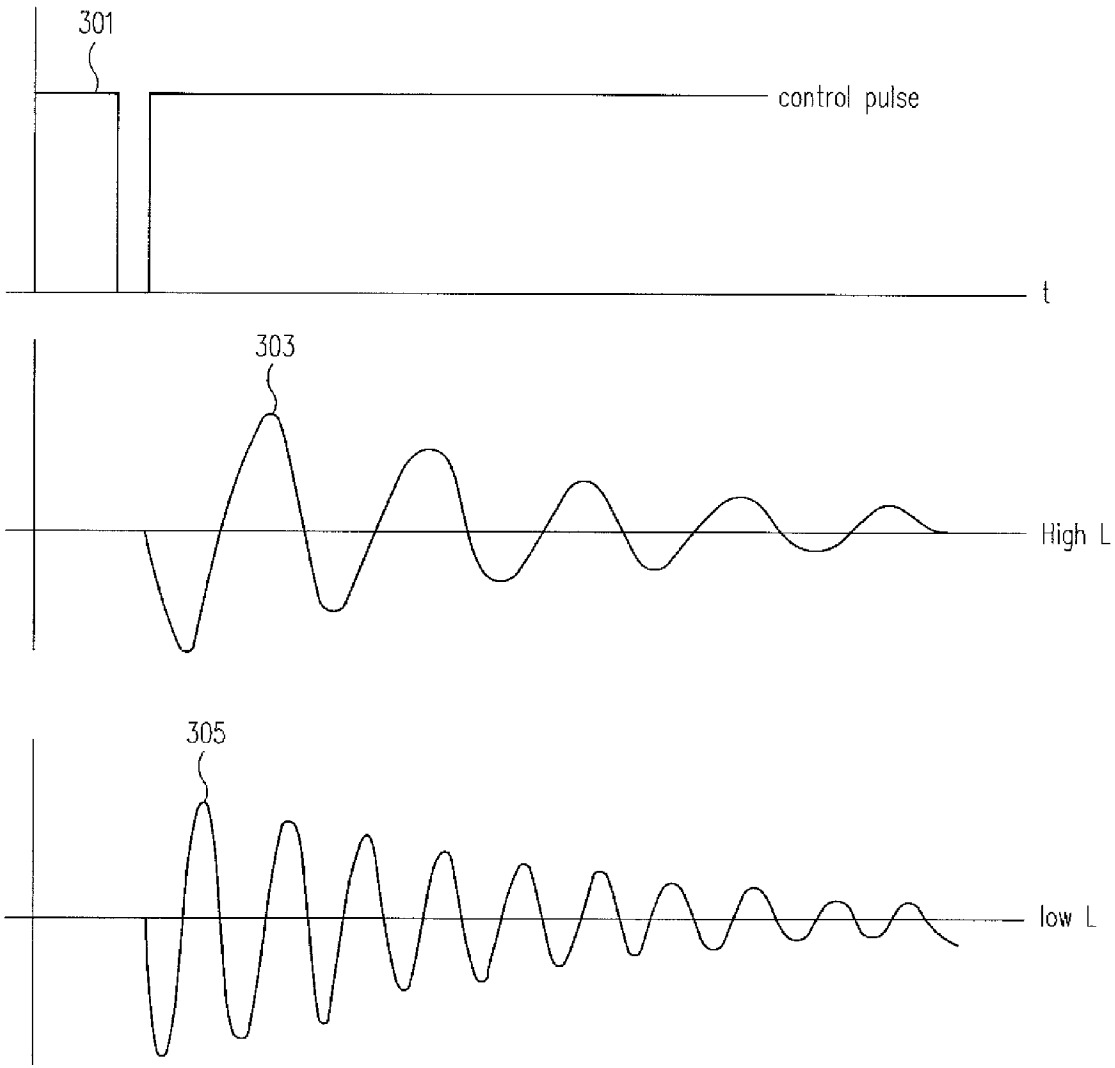
FIG. 3 illustrates waveforms of several oscillating signals of a variable inductor circuit generated in response to a pulse in accordance with an embodiment of the disclosure.

FIG. 3 illustrates several waveforms of oscillating signals of a variable inductor circuit generated in response to a pulse in accordance with an embodiment of the disclosure. Pulse 301 is applied to the variable inductor circuit as discussed. At the end of the pulse, the variable inductor circuit oscillates with a frequency determined by the inductance of the variable inductor. A higher inductance causes the oscillating signal to oscillate with a lower frequency as shown in waveform 303. On the other hand, a lower inductance causes the oscillating signal to oscillate with a higher frequency as shown in waveform 305. The amplitude of the oscillating signal decays over time. The rate at which the amplitude decays may also be a function of the inductance of the variable inductor.

The frequency of the oscillating signal may be measured. When the oscillating signal can no longer be detected due to the decaying amplitude, another pulse may be applied to the variable inductor circuit to generate a second oscillating signal and the measurement of the frequency may be repeated. In one embodiment, a train of pulses may be applied to the variable inductor circuit where the pulses are spaced by an interval greater than the time it takes for the oscillating signal to decay. In this manner, multiple frequency measurements may be taken for a measurement interval that is longer than the decay time of the oscillating signal.

In another embodiment, multiple frequency measurements may be taken of a single oscillating signal provided in response to a single pulse. For example, if the time it takes for an oscillating signal to decay is longer than a minimum measurement interval, the frequency of the single oscillating signal may change as the inductance of the variable inductor changes. Multiple frequency measurements of the single oscillating signal may be taken at multiple non-overlapping periods within the measurement interval to detect if the inductance changes during the measurement interval.

The multiple frequency measurements may be used to determine that a user has selected a setting of the variable control for a time interval. The multiple frequency measurements may also be compared with one another to ensure that they agree with one another within a range. In this manner, the multiple frequency measurements may be used to detect that the user has maintained the variable control in approximately the same position for at least the minimum measurement interval (e.g., a two-second hold in one embodiment) so that the new setting may be accepted. Thus, spurious or inadvertent settings of the variable control may be detected and rejected. Also, the user may thereafter release the variable control (e.g., tailcap 101 in one embodiment) while lighting device 100 retains the selected setting (e.g., in memory 123 in one embodiment).

Referring back to FIG. 2, conditioning circuit 208 may amplify, filter, and shape the oscillating signal to generate a counting clock for oscillation counter 209 to measure the frequency of the oscillating signal. Measurement control circuit 211 may reset oscillation counter 209 at the start of a frequency measurement. Oscillation counter 209 uses the counting clock to increment its count so as to count the number of cycles of the oscillating signal. Oscillation counter 209 may continue counting until the amplitude of the oscillating signal is too attenuated for conditioning circuit 208 to generate the counting clock. Measurement control circuit 211 may count the length of the frequency measurement as the interval during which counting clock is generated. At the end of the frequency measurement, the accumulated count in oscillation counter 209 may be stored into memory 123.

As discussed, a series of frequency measurements may be taken within a pre-determined measurement interval. In one embodiment, the measurement interval may be adjustable. To keep track of the measurement interval, measurement control circuit 211 may use a measurement interval counter to accumulate the length of the multiple frequency measurements. At the start of the measurement interval, measurement control circuit 211 may reset the measurement interval counter. Additionally, at the start of each frequency measurement within the measurement interval, measurement control circuit 211 may reset oscillation counter 209. At the end of the each frequency measurement, the count from oscillation counter 209 may be stored into memory 123. At the end of each frequency measurement, measurement control circuit 211 may also compare the count from oscillation counter 209 with previously stored counts of earlier frequency measurements to determine if the counts are all within an allowable range. If a count is not within the allowable range, measurement control circuit 211 may restart the measurement interval to obtain a new series of frequency measurements. Otherwise, if the counts are all within the allowable range, at the end of the measurement interval, a final count, such as an average of all the counts obtained during the measurement interval, and an average length of the multiple frequency measurements within the measurement interval may be presented to processor 121 to calculate a frequency of the oscillating signal. From the frequency calculation, processor 121 may determine the setting of the variable control and may adjust the brightness of light sources 109 through light source control circuit 125.

FIG. 4 illustrates a schematic of another variable control circuit 400 implemented by another variable inductor circuit 401 connected to another control circuit 402 through a battery 105 in accordance with an embodiment of the disclosure. In contrast to the embodiment of FIG. 2 that uses wires 129/131 to connect between control circuit 206 and variable inductor circuit 201, the embodiment of FIG. 4 uses battery 105 to connect between variable inductor circuit 401 and control circuit 402.

Variable inductor circuit 401 includes variable inductor 202 with variable inductance $L_{sense}$ and may be positioned in base plate 119 near tail cap 101. Control circuit 402 is one embodiment of control circuit 107 of FIG. 1. Control circuit 402 includes processor 121, light source control circuit 125, and memory 123 as discussed with regard to FIG. 1. Control circuit 402 also includes an interface circuit 403 that is an embodiment of interface circuit 127 of FIG. 1. Interface circuit 403 includes an activation circuit 404, conditioning circuit 208, oscillation counter 209, and measurement control circuit 211.

Activation circuit 404 is used to activate variable inductor circuit 401. Activation circuit 404 also provides capacitors that, together with variable inductor circuit 401, form the inductor/capacitor network that generates the oscillating signal (e.g., denoted in FIG. 4 by semi-circular arrows 421). Activation circuit 404 includes a capacitor 406 with capacitance $C_2$ that is connected in series with a capacitor 407 with capacitance $C_3$, and a resistor 405 with resistance $R_2$. The R2/C2/$C_3$ network is connected in parallel with variable inductor 202 through battery 105.

Because battery 105 is used to connect the oscillating signal from variable inductor 202 of variable inductor circuit 401 to activation circuit 404, an alternating current (AC) voltage of the oscillating signal is introduced on the direct current (DC) voltage of battery 105. Accordingly, a low pass filter circuit is connected to battery 105 to filter out the AC voltage of the oscillating signal from the DC voltage of battery 105 before the battery voltage is applied to the rest of lighting device 100. The low pass filter (LPF) includes an inductor 409 with inductance $L_2$ and a capacitor 411 with capacitance $C_4$. The $L_2$/$C_4$ LPF is connected in parallel with the R2/C2/$C_3$ network. A filtered voltage 413 taken from the node between $L_2$ and $C_4$ is used as the DC voltage to power control circuit 402 and light sources 109.

The node between capacitors 406 and 407 is connected to conditioning circuit 208 and a switch 408. Switch 408 is under control of processor 121 and is in the default closed position before the activation of variable inductor circuit 401. This shorts capacitor 407 to ground to allow voltage from battery 105 to charge capacitor 406. When control circuit 402 detects that a user has placed lighting device 100 into a control setting mode to change the setting of the variable control, processor 121 opens switch 408. The voltage on capacitor 406 discharges and causes variable inductor circuit 401 to oscillate with a frequency that is determined by $L_{sense}$, $C_2$, $C_3$, and $R_2$. This activation of the oscillating signal is similar to the action of capacitor 203 discharging its voltage to cause the variable inductor circuit 201 of FIG. 2 to oscillate at the end of the pulse. Similarly, because $L_{sense}$ may vary as the user applies different amounts of force on tail cap 101 to control the variable control, the frequency of the oscillating signal may be measured to determine the setting of the variable control. This oscillating signal is sensed by conditioning circuit 208 through the node between capacitors 406 and 407. The oscillating signal may be illustrated by FIG. 3. Conditioning circuit 208, oscillation counter 209, and measurement control circuit 211 operate to count the number of cycles of the oscillating signal during the measurement interval. Operations of these modules are the same as discussed with regard to FIGS. 2 and 3.

At the end of a frequency measurement, if multiple frequency measurements are desired, processor 121 may close switch 408 again to allow battery voltage to charge capacitor 406. After waiting for capacitor 406 to reach the DC voltage of battery 105, processor may again open switch 408 to cause variable inductor circuit 401 to oscillate and to measure the frequency of the oscillating signal. Thus, multiple frequency measurements may be taken during a measurement interval to ascertain a setting of the variable control.

Figure 5:
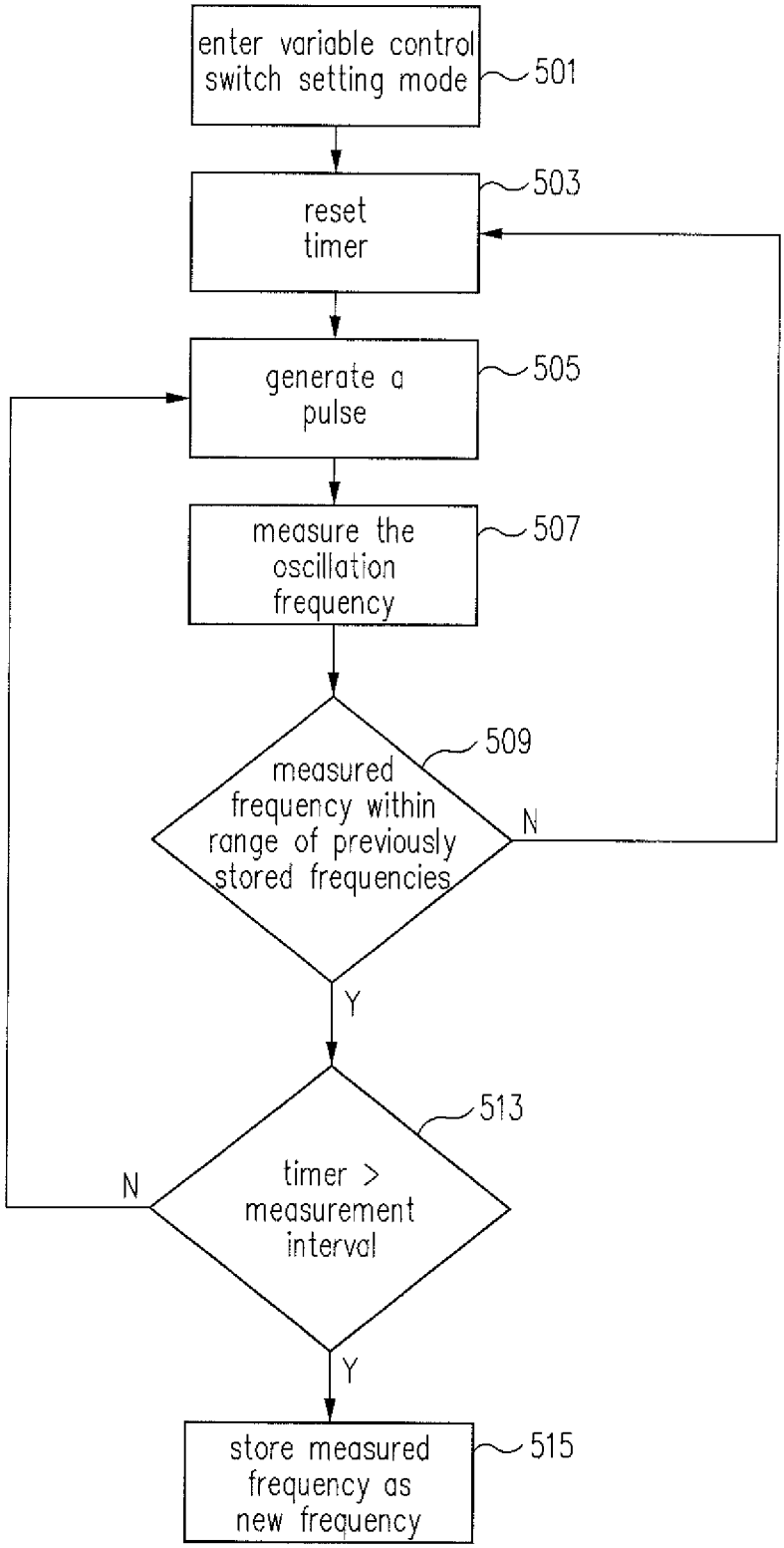
FIG. 5 illustrates a flow chart of steps for measuring a frequency of an oscillating signal to detect a switch setting of a variable control when a decaying time of the oscillating signal is less than a minimum measurement interval in accordance with an embodiment of the disclosure.

FIG. 5 illustrates a flow chart of steps for measuring a frequency of an oscillating signal to detect a switch setting of a variable control when a decaying time of the oscillating signal is less than a minimum measurement interval in accordance with an embodiment of the disclosure.

In step 501, a user enters a control setting mode to change the setting of the variable control. As discussed, such mode may be detected by a processor detecting that the user has actuated tail cap 101 or through another appropriate technique. The user may selectively depress tail cap 101 to select a position of the variable control to cause a change in the inductance of the variable inductor circuit (e.g., 201 of FIG. 2 or 401 or FIG. 4).

In step 503, a measurement interval counter of measurement control circuit 211 of FIG. 2 or FIG. 4 is reset to keep track of the measurement interval. Also instep 503, oscillation counter 209 is reset for measuring the frequency of the oscillating signal.

In step 505, the control circuit 206 or 402 generates a pulse to activate the oscillating signal. As discussed with regards to FIGS. 2 and 4, a voltage across a capacitor connected in parallel with the variable inductor circuit may be charged by a pulse. The voltage on the capacitor may then be discharged to generate the oscillating signal as an oscillating voltage. Alternatively the oscillating signal may be generated as an oscillating current. The frequency of the oscillating signal is a function of the inductance of the variable inductor circuit. Therefore, by measuring the frequency of the oscillating signal, the method may determine the setting of the variable control. In addition the rate at which the amplitude of the oscillating signal decays may also vary with the inductance of the variable inductor circuit. In an alternative embodiment, the rate of decay of the oscillating signal may be measured to determine the setting of the variable control.

In step 507, the measurement interval counter is started to measure the frequency of the oscillating signal. For example, the method may accumulate the number of cycles of the oscillating signal in oscillation counter 209 to measure the frequency. In one embodiment, the frequency of the oscillating signal may be measured for as long as the amplitude of the oscillating signal is detected. For example, as the amplitude of the oscillating signal decays over time, the method may perform the frequency measurement until the amplitude is too attenuated for detection. In another embodiment, the frequency measurement may be performed for a known interval where the interval may be adjustable to accommodate oscillating signals of different frequencies and decaying rates.

In step 509, when the frequency measurement is completed, the currently measured frequency is stored in memory 123. If this is not the first frequency measurement of the measurement interval, the currently measured frequency may be compared against previously measured frequency or frequencies of earlier measurement(s) stored in memory 123. For example, the current count of oscillation counter 209 may be stored and compared with previously stored counts. If the currently measured frequency does not fall within an allowable range of the previously measured frequency or frequencies, the step 503 may be performed again to restart the measurement interval by resetting the measurement interval counter. Thus, the allowable range used for the measurement comparison may be used to detect that the user has held the variable control in approximately the same position during the measurement interval. The allowable range may also be used to reject spurious measurements or inadvertent setting of the variable control. The allowable range may be adjustable to accommodate a desired sensitivity of the control setting of the variable control.

If the currently measured frequency falls with the allowable range of the previously measured frequency or frequencies then, in step 513, the measurement interval counter is compared against a minimum measurement interval to determine if additional frequency measurements are to be performed. If the minimum measurement interval has not been reached, step 505 is performed again to generate an additional pulse to activate an additional oscillating signals for an additional frequency measurement. Steps 505 through 513 are repeated until the measurement interval counter reaches the minimum measurement interval. The minimum measurement interval may be adjustable to accommodate measurements of different oscillating signals.

In another embodiment, if the decaying time of the oscillating signal is longer than the minimum measurement interval, multiple frequency measurements may be taken at multiple non-overlapping periods of a single oscillating signal. In this case, if the minimum measurement interval has not been reached, step 505 may not be repeated to activate another oscillating signal. Instead, step 507 may be repeated to take additional measurements of the same oscillating signal.

In step 515, if the measurement interval counter reaches the minimum measurement interval, the currently measured frequency may be output as the measured frequency in step 515. Alternatively, an average of the currently measured frequency and all the previously measured frequencies taken during the measurement interval may be output as the measured frequency. For example, an average of the current count of oscillation counter 209 and all the previously stored counts may be used. Alternatively, a sum of all the counts taken during the measurement interval along with the measurement interval counter may be provided to processor 121 for processor 121 to determine the frequency of the oscillating signal. Thus, by making multiple frequency measurements for a minimum measurement interval and by comparing the multiple frequency measurements, the method may accept a setting of the variable control only when the user has held the variable control in approximately the same position for at least the minimum measurement interval.

Where applicable, various embodiments provided by the disclosure can be implemented using hardware, software, or combinations of hardware and software. Also where applicable, the various hardware components and/or software components set forth herein can be combined into composite components comprising software, hardware, and/or both without departing from the spirit of the disclosure. Where applicable, the various hardware components and/or software components set forth herein can be separated into sub-components comprising software, hardware, or both without departing from the spirit of the disclosure. In addition, where applicable, it is contemplated that software components can be implemented as hardware components, and vice-versa.

Software in accordance with the disclosure, such as program code and/or data, can be stored on one or more machine readable mediums. It is also contemplated that software identified herein can be implemented using one or more general purpose or specific purpose computers and/or computer systems, networked and/or otherwise. Where applicable, the ordering of various steps described herein can be changed, combined into composite steps, and/or separated into sub-steps to provide features described herein.

Embodiments described above illustrate but do not limit the disclosure. It should also be understood that numerous modifications and variations are possible in accordance with the principles of the disclosure. Accordingly, the scope of the invention is defined only by the following claims.

What is claimed is:

1. A lighting device comprising:

a light source; and a variable control adapted to provide a plurality of control settings, wherein the variable control comprises:

a physical control adapted to be selectively positioned by a user, a variable inductor circuit adapted to exhibit a change in inductance based on the physical control, an activation circuit adapted to induce an oscillating signal in the variable inductor circuit, a frequency measurement circuit adapted to determine, in response to a frequency of the oscillating signal, a control setting associated with the change in inductance, a light source control circuit adapted to control the light source using the determined control setting, and wherein the frequency of the oscillating signal changes with the inductance of the variable inductor circuit.

2. The lighting device of claim 1, wherein the light source control circuit is adapted to adjust a brightness of the light source using the determined control setting.

3. The lighting device of claim 1, wherein the variable inductor circuit is adapted to exhibit the change in inductance in response to a position of the physical control.

4. The lighting device of claim 3, wherein the physical control is a tail cap adapted to be selectively depressed by the user.

5. The lighting device of claim 1, further comprising:

a first electrical connection adapted to pass a pulse from the activation circuit to the variable inductor circuit; and a second electrical connection adapted to pass the oscillating signal between the variable inductor circuit and the frequency measurement circuit.

6. The lighting device of claim 1, wherein:

the activation circuit is adapted to induce the oscillating signal in the variable inductor circuit through a single electrical connection; and the variable inductor circuit is adapted to pass the oscillating signal to the frequency measurement circuit through the single electrical connection.

7. The lighting device of claim 6, further comprising the single electrical connection, wherein the single electrical connection is a battery.

8. The lighting device of claim 7, further comprising a filter circuit adapted to filter out the oscillating signal from a voltage of the battery to generate a filtered voltage to power the light source.

9. The lighting device of claim 1, wherein the activation circuit comprises a processor.

10. The lighting device of claim 1, wherein the activation circuit comprises a switch adapted to selectively bypass a capacitor.

11. The lighting device of claim 1, wherein:

the activation circuit is adapted to induce a plurality of oscillating signals in the variable inductor circuit;

the frequency measurement circuit is adapted to determine, in response to measuring frequencies of the oscillating signals, a plurality of control settings; and the light source control circuit is adapted to control the light source using the determined control settings.

12. The lighting device of claim 1, wherein the lighting device is a flashlight.

13. A method of operating a lighting device, the method comprising:

receiving a user manipulation of a physical control that causes a variable inductor circuit to exhibit a change in inductance;

inducing, by an activation circuit, an oscillating signal in the variable inductor circuit, wherein a frequency of the oscillating signal changes with the inductance of the variable inductor circuit;

determining, by a frequency measurement circuit in response to the frequency of the oscillating signal, a control setting associated with the change in inductance; and controlling, by a light source control circuit, a light source using the determined control setting.

14. The method of claim 13, wherein the controlling the light source comprises adjusting a brightness of the light source using the determined control setting.

15. The method of claim 13, wherein the variable inductor circuit is adapted to exhibit the change in inductance in response to a position of the physical control that changes in response to the user manipulation.

16. The method of claim 15, wherein the physical control is a tail cap adapted to be selectively depressed by the user.

17. The method of claim 15, further comprising:

receiving a plurality of user manipulations that move the physical control through a plurality of positions;

inducing a plurality of oscillating signals in the variable inductor circuit;

measuring the oscillating signals to determine a plurality of control settings associated with the positions of the physical control; and controlling the light source using the determined control settings.

18. The method of claim 13, further comprising:

passing a pulse from the activation circuit to the variable inductor circuit through a first electrical connection; and passing the oscillating signal between the variable inductor circuit and the frequency measurement circuit through a second electrical circuit.

19. The method of claim 13, wherein the inducing is performed through a single electrical connection, the method further comprising passing the oscillating signal between the variable inductor circuit and the control circuit through the single electrical connection.

20. The method of claim 19, wherein the single electrical connection is a battery, the method further comprising filtering out the oscillating signal from a voltage of the battery to generate a filtered voltage to power the light source.

21. The method of claim 13, wherein the activation circuit comprises a processor.

22. The method of claim 13, wherein the inducing comprises opening a switch to selectively bypass a capacitor.

23. The method of claim 13, wherein the lighting device is a flashlight.

* * * * *